United States Patent [19]

Knox

[11] Patent Number: 4,633,849

[45] Date of Patent: Jan. 6, 1987

[54] CENTRAL FEED ROTARY AUTOMATIC ASH DISCHARGE STOKER

[75] Inventor: Harold L. Knox, Grosse Ile, Mich.

[73] Assignee: Detroit Stoker Company, Monroe, Mich.

[21] Appl. No.: 554,057

[22] Filed: Nov. 21, 1983

[51] Int. Cl.[4] ..... F23H 9/00; F23K 3/18

[52] U.S. Cl. ..... 126/182; 126/242; 110/275; 110/247

[58] Field of Search ..... 126/242, 152 R, 169, 126/154, 182; 110/275, 286, 101 R, 165 R, 182.5, 115, 314, 247; 48/66, 180 S, 113

[56] References Cited

U.S. PATENT DOCUMENTS

| | | | |
|---|---|---|---|
| 575,305 | 1/1897 | Morgan | 126/182 |
| 1,724,352 | 8/1929 | Ilving . | |
| 1,761,182 | 6/1930 | Grothers | 110/182.5 |
| 1,913,668 | 6/1933 | Haug | 110/275 X |
| 2,001,274 | 5/1935 | Haug | 110/275 X |
| 2,069,584 | 2/1937 | Lorton | 110/247 |
| 2,505,363 | 4/1950 | Nicholo | 110/247 X |
| 2,808,321 | 10/1957 | Junkers | 48/66 |
| 3,367,644 | 2/1968 | Ban | 263/28 |
| 4,384,534 | 5/1983 | Lamb et al. | 110/247 X |
| 4,388,876 | 1/1983 | Burton | 110/275 |
| 4,437,452 | 3/1984 | Reschly | 110/275 |

OTHER PUBLICATIONS

Blueprint entitled "Assembly Wet Cell Burner LWC-602", Weyerhauser Co., Grayling, Michigan, Cont. #691-001-3, Drawing #15347.

*Primary Examiner*—Larry Jones

*Attorney, Agent, or Firm*—Harness, Dickey & Pierce

[57] ABSTRACT

The rotary stoker has a fuel supporting grate which is divided into a central stationary section and an outer rotating ring. Fuel is fed to the center of the stationary section. The outer ring is downwardly and centrally inclined, as an inverted cone, and lies partially beneath the stationary section to form an annular trough of V-shaped cross section. Openings or spaces separate the stationary section and outer ring, in the bottom of the trough, for continuous ash removal into a hopper as the ring rotates. Air may be admitted through the under sides of both sections of the grate from separately controlled air plenums. Air may also be admitted above the grate from a third, separately controlled air plenum.

46 Claims, 4 Drawing Figures

CENTRAL FEED ROTARY AUTOMATIC ASH DISCHARGE STOKER

BACKGROUND OF THE INVENTION

1. Field of the Invention

The present invention relates generally to mechanical stokers, and particularly to an improved construction of a rotary grate continuous ash discharge stoker in which the rotary grate includes an inclined rotating outer ring. This improved construction may be used in either an overfeed or an underfeed mechanical stoker design. Numerous other possible designs and combinations thereof are includable in the scope of the invention.

2. Description of the Prior Art

Rotary continuous ash discharge stokers are known which have a substantially horizontally circular grate which is designed to support burning fuel as it distributes the fuel from the feed point over the entire grate, and at the same time automatically removes the ash therefrom. Another known rotary stoker employs a pair of concentric rotating grates in stepped relation to one another; the outer grate disposed above the inner grate. It is also known to provide for the controlled admission of air for combustion of the fuel in a controlled and efficient manner. In particular, the assignee of the present invention has developed a continuous ash discharge rotary stoker which is described in the U.S. Pat. No. 4,437,452, issued to David C. Reschly on Mar. 20, 1984, based on application Ser. No. 482,015 and entitled "Rotary Continuous Ash Discharge Stoker". Said application was filed Apr. 11, 1983 and is a continuation of application Ser. No. 62,327 filed July 31, 1979, now abandoned. In that Patent is described a rotary stoker in which the upper grate surface consisted of two zones, a central stationary section and an outer rotating section or ring. The central section is inclined and provides a main air admitting zone. The outer rotating ring is generally horizontal and serves to distribute the fuel in the furnace with the aid of a stationary spreader arm. Air is also admissible through the rotating ring to aid combustion and the burned out ash from the furnace is removed at the outer periphery with the aid of a stationary ash plow. Said invention thus provides a stoker which is capable of continuous operation (although it is also possible to halt the continuous operation by stopping the rotating ring and ceasing to feed fuel).

In addition to providing for the continuous burning of fuel and removal of ash, the Reschly invention provides a wide latitude of control over the admission of air, both below the fuel supported grate and above the grate. Separate wind boxes or air plenums, receptive of pressurized air, and separately controllable, allow the furnace or boiler operator to optimize combustion by admitting air in the precise zone or zones as needed.

While the above-described stoker design has proven to be quite advantageous, further improvements in the design to promote more even and complete combustion and smoother, more trouble free ash removal are always desirable.

SUMMARY OF THE INVENTION

In the pursuit of further improvements in rotary stokers, the present invention comprises an improved multizone grate for supporting burning fuels. The grate includes a central stationary section and an outer rotating ring in which the outer rotating ring has a fuel supporting surface which lies generally in a conical configuration partially beneath the stationary section. The central stationary section is conical or pyramidal in shape and has tuyeres receptive of pressurized air from an air plenum through which blasts of air may be admitted to aid combustion. Fuel is centrally fed onto or up through the apex of the central section.

The rotating ring is disposed generally radially outwardly and partially beneath the central stationary section and takes the form of a conically inclined grate through which pressurized air may be admitted via a separate air plenum. The central stationary section and the outer rotating ring both provide annular fuel supporting surfaces which overlie or intersect one another to define an annular trough. The fuel supporting surfaces, which form the sidewalls and/or bottom wall of the trough, direct the fuel and ash downwardly towards the ash collection hopper below the grate. As the fuel within the trough is burned, the ash sifts downwardly to the lower periphery of the rotating ring where it falls into the ash collection hopper. Motion of the ash towards the lower periphery of the ring is aided by the rotation of the ring and by the downward forces exerted upon it by the charge of fuel above. The central stationary section is provided with surfaces which act as ash plows to further aid in ash removal. Additional ash plows may be added if desired.

In addition to the air plenums supplying air through the stationary section and the rotating ring, an additional air plenum may also be provided generally above the grate, as about the inner wall of the combustion chamber. Each of these air plenums is receptive of pressurized air and a means is provided for separately controlling the air supplied to each of the plenums.

For a more complete understanding of the invention, its objects and advantages, reference may be had to the following specification and the accompanying drawings.

BRIEF DESCRIPTION OF THE DRAWINGS

FIG. 3 is a detailed vertical sectional view of the grate portion of the stoker of FIG. 1.

DESCRIPTION OF THE PREFERRED EMBODIMENT

Figure 1:
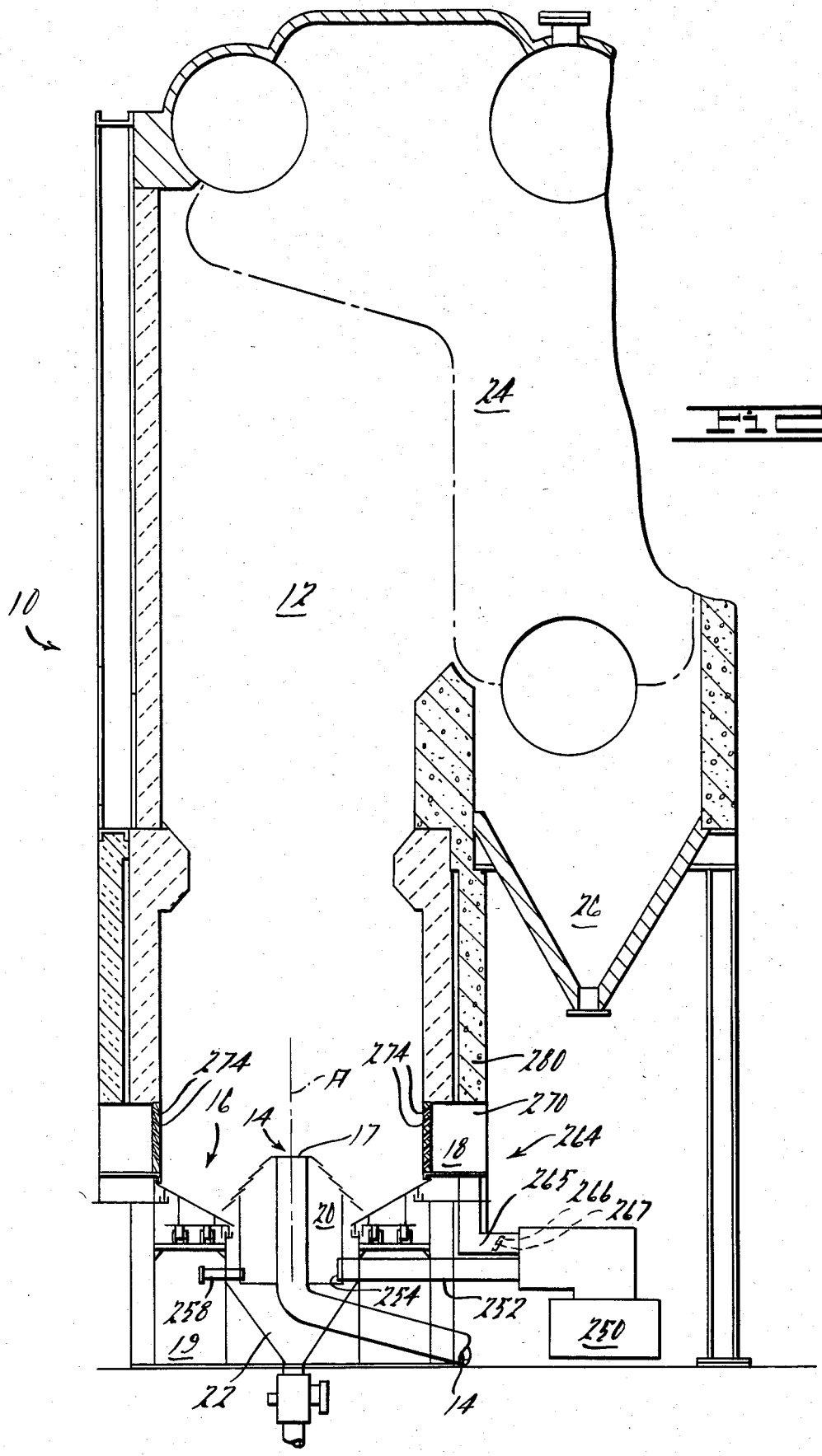
FIG. 1 is a vertical sectional view of a boiler incorporating a stoker of the present invention with certain portions broken away, the stoker being shown somewhat diagramatically.

Referring now to FIG. 1, an improved central feed rotary stoker 10 is illustrated. Stoker 10 includes furnace area 12, fuel feed 14, circular grate 16, air plenums 18, 19, and 20, ash collection hopper 22, superheater area 24, and collection area 26 to collect ash particles carried outside of the furnace area by heated gases. The collected particles from the collection area 26 may or may not be directly reinjected into the furnace for further burning of any combustible material that they may contain. Various other areas and devices would be included downstream of the furnace area 12 beyond the broken away portion of FIG. 1, as known in the art.

Also shown in FIG. 1 is the air supply unit or blower 250.

Various types of conventional fuel feeders may be employed at feed point 14. The fuel feeder utilized may depend on the fuel used in stoker 10. Typical fuels utilized are bituminous and lignite coal, wood, coke breeze, bagasse, bark, municipal refuse, or any other cellulose or by product waste fuel. Fuel feed 14 directs the fuel up through central orifice 17 in the center of grate 16. In an alternative embodiment shown in FIG. 4, fuel feed 14' directs the fuel to centercap 74' of grate 16.

Figure 2:
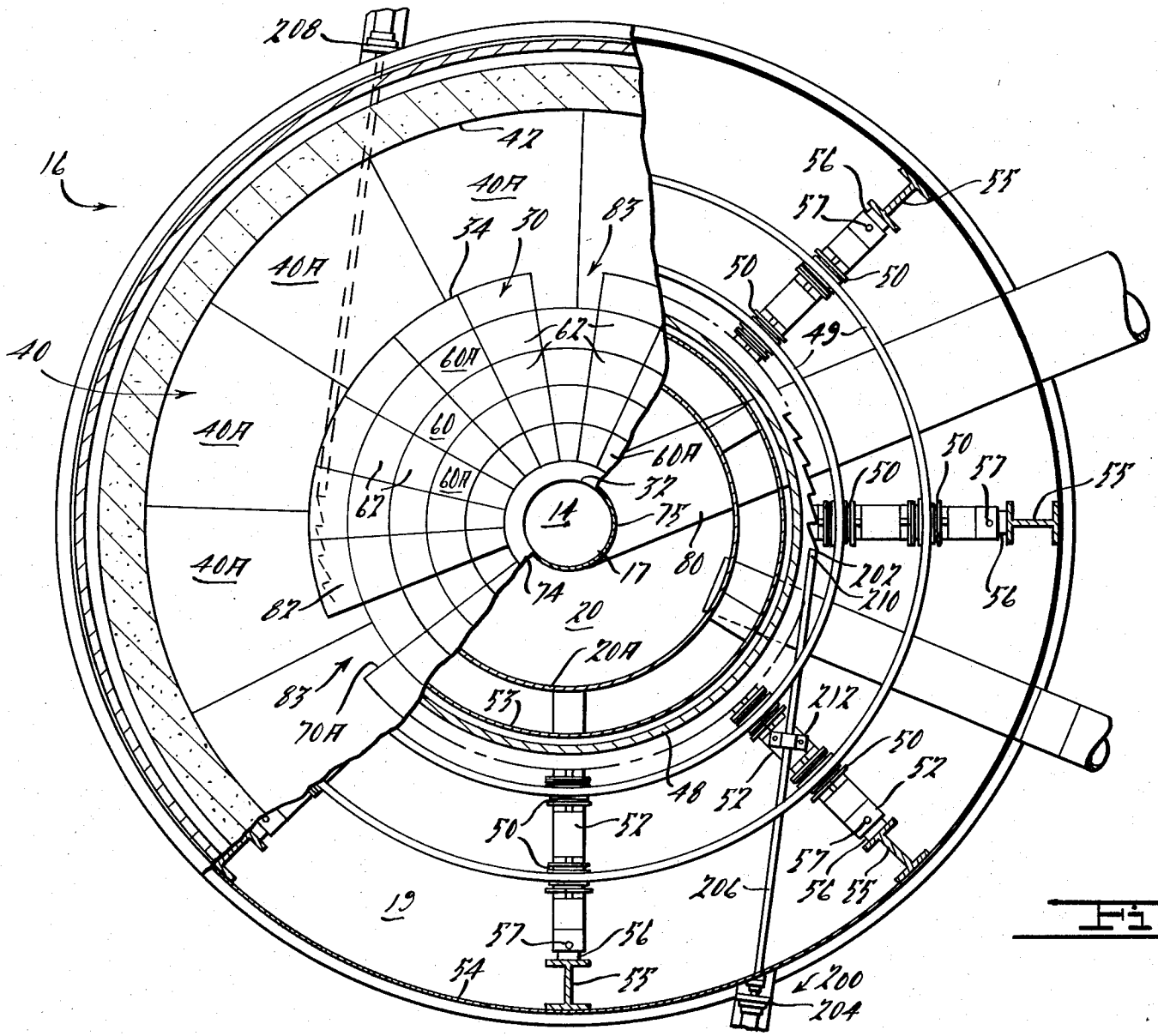
FIG. 2 is a cross-sectional view of the grate portion of the stoker of FIG. 1, taken along the line 2—2 of FIG. 3.
Figure 2:
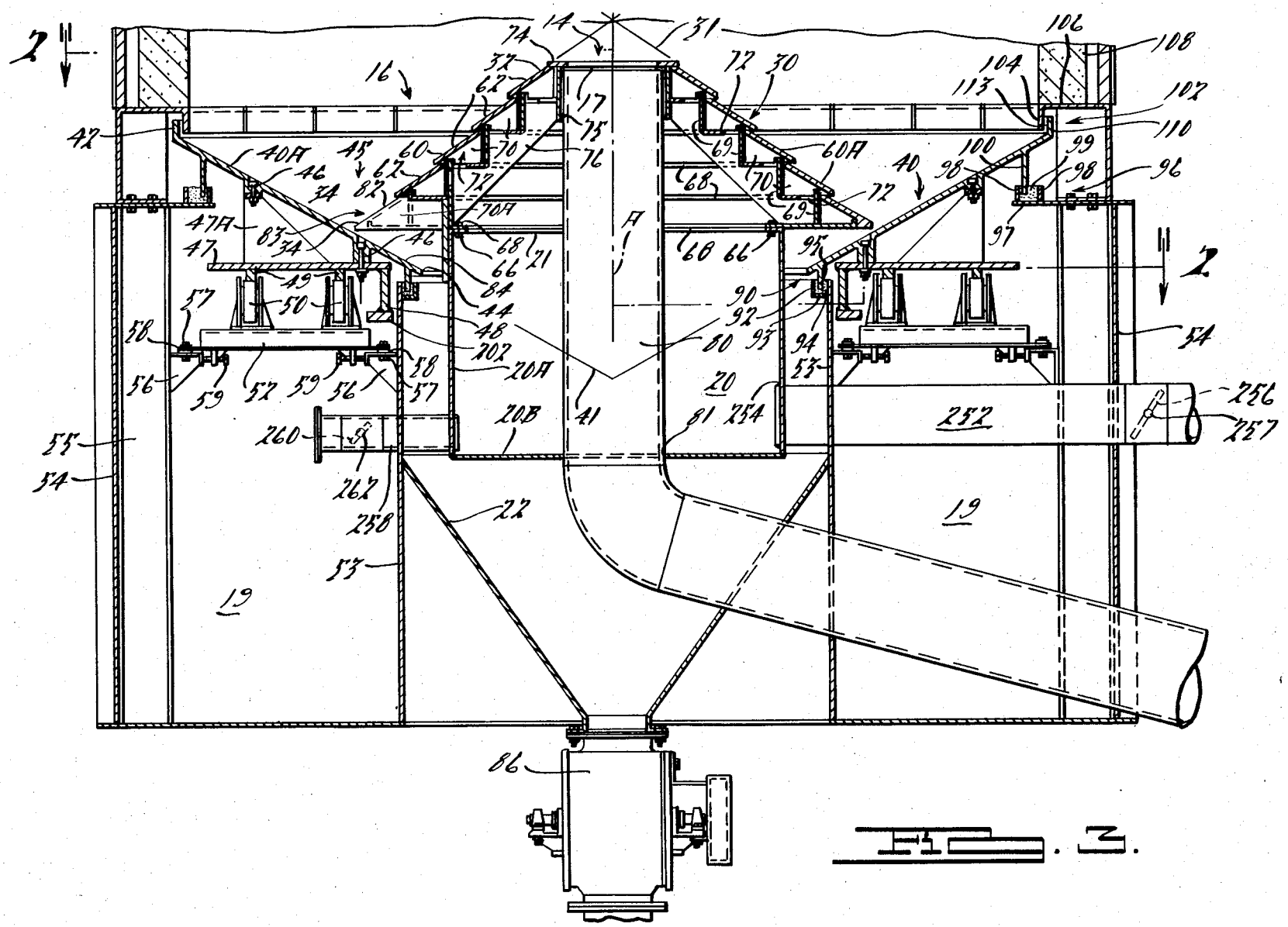

Referring to FIGS. 2 and 3, grate 16 is shown in detail. The upper grate surface of grate 16 consists of two zones, central stationary section 30 and outer rotating section or ring 40. Central section 30 is inclined such that its upper periphery 32 lies in a plane above its lower periphery 34. Central section 30 is a main air admitting zone. Outer rotating ring 40 is inclined such that its outer periphery 42 lies in a plane above its inner periphery 44. In other words, upper periphery 42 lies radially outside lower periphery 44. Rotating ring 40 is disposed partially beneath central section 30. More specifically, approximately 30% of the radial extent of ring 40 lies beneath central stationary section 30. Central stationary 30 and rotating ring 40 both provide annular fuel supporting surfaces which overlie or intersect one another to define annular trough 45 which has a generally V-shaped or U-shaped radial cross-section. Both fuel supporting surfaces of sections 30 and 40 lie generally in conical configurations, shown diagramatically in FIGS. 1 and 3 by contour lines 31 and 41, respectively. As seen in FIGS. 1 and 3, contour 31 inclines upwardly towards the central axis A of grate 16, while contour 41 declines towards axis A. Central stationary section 30 and outer rotating ring 40 are thus generally conical or frusto-conical in shape. Outer rotating ring 40, like central section 30, is an air admitting zone.

The outer rotating ring 40 is made up of several grate sections 40A which are bolted as at 46 to horizontally disposed annular supporting member 47. Supporting member 47 includes upwardly projecting triangular supporting webs 47A for securing ring 40 to member 47. Member 47 also includes downwardly depending ratchet drive member 48 secured at the inner periphery of member 47 as will be discussed more fully below. Annular rails 49 are secured to the underside thereof and supported on rollers 50. Rollers 50 are in turn supported on horizontal cross rail or beam 52 secured between the inner and outer walls 53 and 54 of air plenum 19 by means of buttress support brackets 56 and vertical I beam support members 55. Beam 52 may be bolted as at 57 to support brackets 56. Shims 58 may be provided to adjust the elevation of outer ring 40. Radial positioning of ring 40 is provided by means of bolts 59 which are carried on the underside of beam 52 and may be turned inwardly and outwardly against support brackets 56 to secure beam 52 in any desired radial position.

Stationary central section 30 of grate 16 comprises inclined circular grate 60 having a number of vertically arranged, circumferentially spaced tuyeres, generally designated 62, inset throughout grate 60. Tuyeres 62 are inclined downwardly as shown in FIG. 3, to prevent fuel and ash from sifting into air plenum 20.

Inner air plenum 20 is a cylindrical box with sidewalls 20A and bottom wall 20B having an opening 21 in the top thereof through which pressurized air is delivered to tuyeres 62.

Central section 30 is comprised of a plurality of stacked horizontal ring members 68, having upstanding flange members 69 secured as by welding thereto. Circular grate 60 comprises a plurality of annular grate sections 60*a*, each section being supported by triangular supports 70 formed in or secured to ring members 68. Ring members 68 include air passageways 72 which communicate with tuyeres 62 and with air plenum 20. At the top of stationary central section 30 is cap 74 through which central orifice 17 passes. Cap 74 is secured to cylindrical hub 75 which in turn is supported by a plurality of downwardly and outwardly extending, radially spaced rafters 76. Rafters 76 are carried by the lowermost ring 68, and the entire stationary section 30, thus described, is secured to air plenum 20 as with bolts 66. Underfeed fuel delivery pipe 80 enters from beneath grate 16 and passes through opening 81 in the bottom wall 20B of air plenum 20 for connection to feed point 14 through central orifice 17.

As seen in the left-hand side of FIG. 3 and in FIG. 2, the lowermost grate section 82 includes opening 83 for ash removal. Ash which has shifted to the V-shaped bottom of trough 45 falls to the innermost portion 84 of rotating ring 40, and there slides down the incline and is funneled by conically-shaped hopper 22 into the ash box or ash removal system 86. Because ring 40 is rotating with respect to member 30, the exposed triangular support member 70A doubles as an ash plow. In implementing the invention, a plurality of these openings 83 may be spaced circumferentially about the lowermost portion of stationary member 30. Alternatively, an annular opening about the entire circumference of stationary member 30 may be employed. Still further, rotating ring 40 may be formed with openings or down steps to provide a clearance space between stationary member and rotating ring so that ash may fall into hopper 85. Opening 83 located in or near the bottom of V-shaped trough 45, thus provides a means for continuous ash removal while ring 40 is rotating. Likewise, central fuel feed 80 may be operated to continuously stoke fresh fuel to the center and top of the fuel pile, thereby providing a stoker which may be run continuously at a uniform burning rate and without the need to shut down for periodic ash removal.

Figure 4:
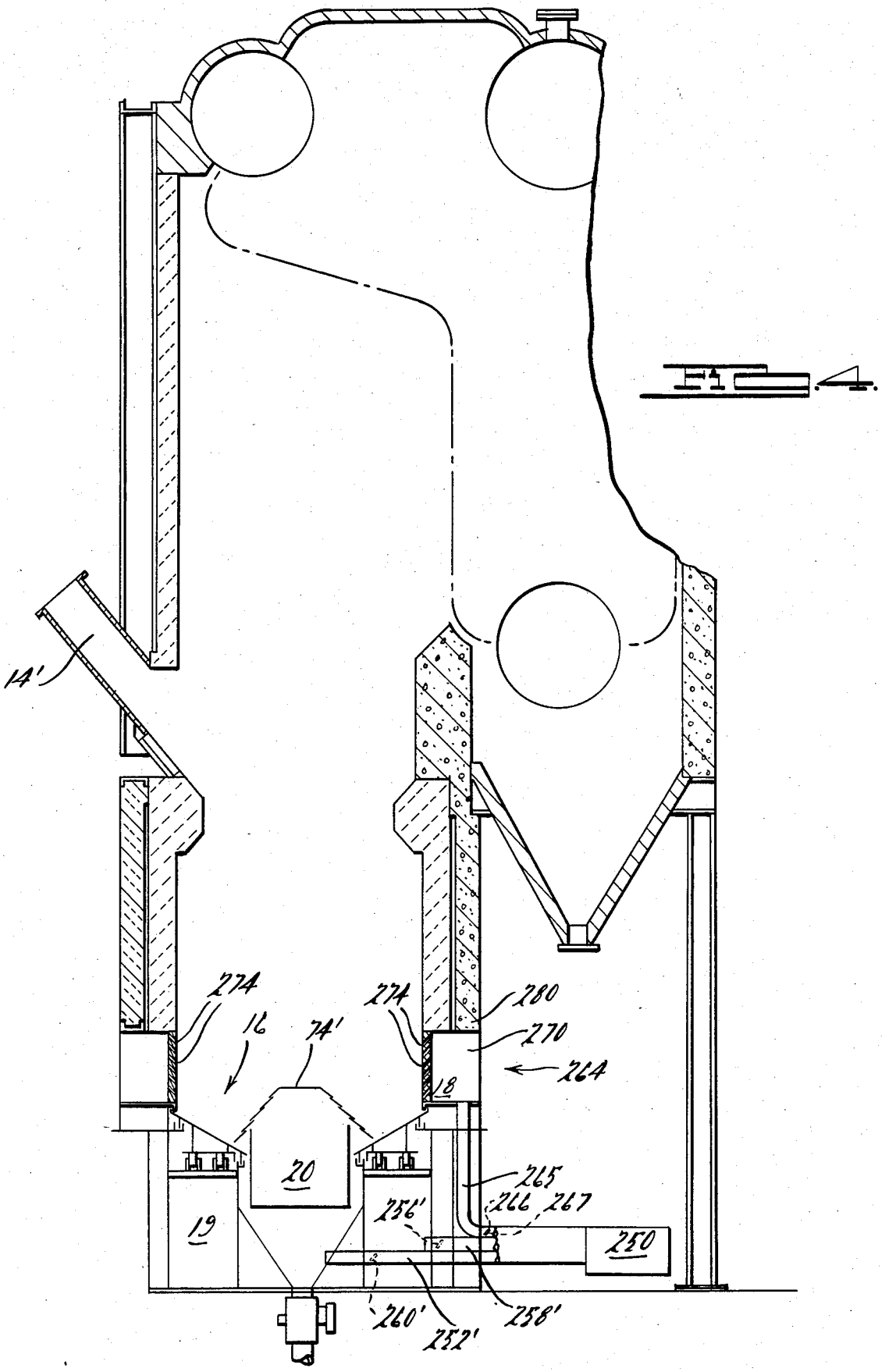
FIG. 4 is a diagramatic vertical sectional view, similar to FIG. 1, showing alternative means for control of air flow and alternate fuel feed.

An alternative fuel feeding arrangement is shown in FIG. 4. In this overfeed alternative embodiment fuel is stoked through downwardly inclined infeed chute 14' directed towards central target cap 74'. In this alternative embodiment cap 74' would not include a central orifice, and underfeed tube 81 could be omitted Otherwise, this overfeed embodiment may be constructed substantially in accordance with the above description.

Rotating ring 40 is preferably sealed at both inner and outer peripheries The inner peripheral seal 90 is disposed on inner wall 53 of air plenum 19 and comprises, preferably, a channel forming or trough forming annular vertical flange 92 secured to sidewall 53 by lateral flange 93. The annular channel 94 formed by sidewall 53 and flanges 92 and 93 is positioned to receive downwardly depending annular flange 95 at inner periphery 44 of ring 40. Channel 94 is preferably filled with sand, ash, or other particulate matter to complete the airtight seal. A similarly constructed outer peripheral seal 96 is provided adjacent outer periphery 42 of ring 40. Seal 96 comprises a laterally extending annular member 97 attached to or extending inwardly from outer wall 54 of air plenum 18. Member 97 includes a pair of side by side upstanding annular flanges 98 which, together with member 97, form an annular trough or channel 99. Downwardly depending annular flange 100 secured to rotating ring 40 is disposed partially within channel 99, and channel 99 may be filled with sand, ash, or other particulate matter to form an airtight seal. To provide a further seal to prevent ash and fuel from entering air plenum 19 second outer peripheral seal 102 is provided. Seal 102 comprises downwardly extending annular flange 104 which is secured to or cantilevered to a structural member such as member 106 upon which furnace wall 108 is founded. Outer periphery 42 of rotating ring 40 terminates in an upturned annular flange 110 which is disposed radially adjacent flange 104. Flanges 104 and 110 cooperate to form, in essence, an S trap or serpentine passageway 113 which permits rotary movement of ring 40 and flange 110 with respect to the stationary furnace wall 108 and flange 104, and yet prevents fuel and ash from entering air plenum 19.

The drive means 200 of outer ring 40 comprises drive ratchet 202 driven by two hydraulic cylinders 204 and 208. As shown in FIG. 2, hydraulic cylinder 204 includes drive piston rod 206 having head 210 for engaging drive ratchet 202. Drive piston rod 206 is guided by guide bracket 212 secured to beam 52. Hydraulic cylinder 208 is coupled with drive ratchet 202 at the opposite drive point of cylinder 204 so that hydraulic cylinders 204 and 208 operate in unison, at opposite sides of ratchet 202, to rotate the ratchet. Sequential operation is also within the scope of the invention. Ratchet 202 is coupled to ratchet drive member 48, which is in turn coupled to outer ring 40. While ratchet drive is presently preferred, those skilled in the art will recognize that a number of functionally equivalent drive mechanisms may be utilized without departing from the scope of the invention.

The air supply system, denoted generally by reference numeral 250 in FIG. 1, provides the forced draft air utilized in the combustion process which is passed through the fuel from the underside of grate 16. With reference to FIGS. 1 and 3, a first air supply embodiment is illustrated in which air duct 252 receives pressurized or forced air from air supply system 250 and transmits it to air plenum 20 through orifice 254 in sidewall 20A of air plenum 20 Control damper 256 carried within air duct 252 may be adjusted by means of adjustment knob 257 to control the air flow to air plenum 20. Air duct 258 communicates between air plenum 20 and air plenum 19 for delivering air from air supply 250, through air plenum 20, into air plenum 19. Control damper 260 with adjustment knob 262 is provided so that the air flow supplied to plenums 19 and 20 may be separately controlled. An alternative air supply is illustrated in FIG. 4. In this alternative embodiment, separate air supply ducts 252′ and 258′ are provided for independent connection to air supply system 250. Each supply duct includes control dampers 256′ and 260′, thereby providing means for separately controlling the air supplied to plenums 19 and 20, respectively.

Although not required in all applications, the invention may include optional overgrate air supply system 264, shown in FIG. 1. Air supply system 264 includes air duct 265 which is coupled with optional furnace wall air plenum 18 to provide pressurized air to annular duct 270 at the periphery of the refractory portion 280 about the inner wall of the furnace. Annular duct 270 includes a plurality of tuyeres 274 spaced circumferentially along the inner furance wall. Tuyeres 274 are preferably downwardly directed to prevent ash from entering air plenum 18. Air duct 265 includes control damper 266 and control knob 267 for separately controlling the air suplied to air plenum 18. The admission of air along the sidewall of the furnace in this manner permits further control of combustion of the fuel upon grate 16 and also of any gases or suspended fuel above the grate. The control afforded by providing separate, independently supplied, air plenum, both under and over the fuel, makes it possible to maintain combustion at low fuel loads and high fuel loads alike. The sidewall or overfire air increases turbulence which can reduce stratification of air along the furnace walls for more efficient combustion. The flow of air along the furnace sidewalls cools the walls to eliminate clinker formation or slag adhesion to the refractory or furnace wall. Furthermore, the admission of overfire air, particularly if introduced into an afterburner region or chamber, can increase fuel efficiency by burning gases and suspended particulate.

While it will be apparent that the preferred embodiments of the invention disclosed are well calculated to fulfill the objects above stated, it will be appreciated that the invention is susceptible to modification, variation, and change without departing from the proper scope or fair meaning of the subjoined claims.

What is claimed is:

1. A rotary stoker for use in a combustion chamber comprising:

(a) a grate for supporting burning fuel, said grate comprising a central stationary section and an outer rotating ring, said outer rotating ring having a rotating fuel supporting surface generally disposed in a downwardly and inwardly converging conical configuration;

said central stationary section and said fuel supporting surface downwardly converging and overlapping to form a circular vertex lying within the radial confines of said combustion chamber;

(b) a compartment located directly under said grate for supplying pressurized air through said grate to the fuel supported thereon;

(c) air supply means for supplying pressurized air to said compartment;

(d) means for continuously removing ash from said grate; and (e) means for rotating said outer ring with substantial circumferential movement about said central stationary section.

2. The stoker of claim 1 wherein said outer rotating ring has an upper periphery and a lower periphery and said means for removing ash includes means positioned directly beneath said lower periphery for receiving ash from said grate.

3. The stoker of claim 1 wherein said outer rotating ring has an outer periphery of an inner periphery and said means for removing ash includes means positioned directly beneath said inner periphery for receiving ash from said grate.

4. The stoker of claim 1 further comprising a second compartment located directly under said grate for supplying pressurized air through said grate to the fuel supported thereon.

5. The stoker of claim 4 further comprising means for supplying presurized air to both of said compartments and means for separately controlling the air supplied to each of said compartments.

6. The stoker of claim 1 further comprising fuel feeding means for supplying fuel to said central stationary section.

7. The stoker of claim 1 further comprising fuel feeding means disposed below said grate for supplying fuel to said grate.

8. The stoker of claim 1 further comprising fuel feeding means for supplying fuel to said central stationary section, said feeding means being disposed below said central stationary section.

9. The stoker of claim 1 wherein said means for continuously removing ash comprises means for defining a separation between said central stationary section and said outer rotating ring.

10. The stoker of claim 1 wherein said outer rotating ring includes a portion thereof which underlies said central stationary section.

11. The stoker of claim 10 wherein said central stationary section includes an opening adjacent said portion of said outer rotating ring for removing ash from said grate.

12. The stoker of claim 1 wherein said central stationary section includes an opening therein and means exposed by said opening for diverting ash carried on said grate.

13. The stoker of claim 1 further comprising second compartment located directly under said grate for supplying pressurized air through said rotating ring and means disposed on said rotating ring for forming an air seal with said second compartment.

14. The stoker of claim 1 for use within a furnace having an inner furnace wall further comprising annular trap disposed about said inner furnace wall and about the outer periphery of said rotating ring.

15. The stoker of claim 14 wherein said tap comprises first annular flange coupled to said inner furnace wall and second annular flange disposed on said rotating ring, said first and second flanges cooperating to prevent material from passing between said rotating ring and said furnace wall while permitting said ring to rotate with respect to said furnace wall.

16. The stoker of claim 1 wherein said outer rotating ring is generally disposed in a downwardly converging conical configuration.

17. A rotary stoker for use in a combustion chamber comprising:

(a) a grate for supporting burning fuel, said grate comprising a central stationary section and a downwardly and inwardly sloping fuel supporting outer rotating ring, said central stationary section and said outer rotating ring downwardly converging to define an annular fuel carrying trough of generally V-shaped radial cross-section the lowermost portion of said trough disposed within the radial confines of said combustion chamber;

(b) a compartment located directly under said grate for supplying pressurized air through said grate to the fuel supported thereon;

(c) air supply means for supplying pressurized air to said compartment;

(d) means for continuously removing ash from said grate; and (e) means for rotating said outer ring with substantial circumferential movement about said central stationary section.

18. The stoker of claim 17 wherein said trough has a generally V-shaped radial cross section.

19. The stoker of claim 17 wherein said trough has a generally U-shaped radial cross section.

20. The stoker of claim 17 wherein said means for removing ash includes means positioned beneath said trough for receiving ash therefrom.

21. The stoker of claim 17 further comprising a second compartment located directly under said grate for supplying pressurized air through said grate to the fuel supported thereon.

22. The stoker of claim 21 further comprising means for supplying pressurized air to both of said compartments and means for separately controlling the air suplied to each of said compartments.

23. The stoker of claim 17 further comprising fuel feeding means for supplying fuel to said central stationary section.

24. The stoker of claim 17 further comprising fuel feeding means disposed below said grate for supplying fuel to said grate.

25. The stoker of claim 17 further comprising fuel feeding means for supplying fuel to said central stationary section, said feeding means being disposed below said central stationary section.

26. The stoker of claim 17 wherein said trough includes an opening in the bottom thereof through which ash is automatically discharged.

27. The stoker of claim 17 wherein said central stationary section and said outer rotating ring define walls of said trough.

28. The stoker of claim 17 wherein said outer rotating ring includes a portion thereof which underlies said central stationary section.

29. The stoker of claim 17 wherein said central stationary section includes an opening therein and means exposed by said opening for diverting ash carried on said grate.

30. The stoker of claim 17 further comprising second compartment located directly under said grate for supplying pressurized air through said rotating ring and means disposed on said rotating ring for forming an air seal with said second compartment.

31. The stoker of claim 17 for use within a furnace having an inner furnace wall further comprising annular trap disposed about said inner furnace wall and about the outer periphery of said rotating ring.

32. The stoker of claim 31 wherein said trap comprises first annular flange coupled to said inner furnace wall and second annular flange disposed on said rotating ring, said first and second flanges cooperating to prevent material from passing between said rotating ring and said furnace wall while permitting said ring to rotate with respect to said furnace wall.

33. A rotary stoker for use in a combustion chamber having a chamber wall comprising:

(a) a grate for supporting burning fuel, said grate comprising a central stationary section and an outer rotating ring, said outer rotating ring being detached from said chamber wall and including means for downwardly and inwardly inclining said outer rotating ring;

said central stationary section and said outer rotating ring downwardly and inwardly converging and overlapping to define a circular fuel supporting vertex lying within the radial confines of said combustion chamber walls;

(b) a compartment located directly under said grate for supplying pressurized air through said grate to the fuel supported thereon;

(c) air supply means for supplying pressurized air to said compartment; and (d) means for removing ash from said grate.

34. The stoker of claim 33 wherein said outer rotating ring has an upper periphery and a lower periphery and said means for removing ash includes means positioned directly beneath said lower periphery for receiving ash from said grate.

35. The stoker of claim 33 wherein said outer rotating ring has an outer periphery and an inner periphery and said means for removing ash includes means positioned directly beneath said inner periphery for receiving ash from said grate.

36. The stoker of claim 33 further comprising a second compartment located directly under said grate for supplying pressurized air through said grate to the fuel supported thereon.

37. The stoker of claim 36 further comprising means for supplying pressurized air to both of said compartments and means for separately controlling the air supplied to each of said compartments.

38. The stoker of claim 33 further comprising fuel feeding means for supplying fuel to said central stationary section.

39. The stoker of claim 33 further comprising fuel feeding means disposed below said grate for supplying fuel to said grate.

40. The stoker of claim 33 further comprising fuel feeding means for supplying fuel to said central stationary section, said feeding means being disposed below said central stationary section.

41. The stoker of claim 33 wherein said means for continuously removing ash comprises means for defining a separation between said central stationary section and said outer rotating ring.

42. The stoker of claim 33 wherein said outer rotating ring includes a portion thereof which underlies said central stationary section.

43. The stoker of claim 42 wherein said central stationary section includes an opening adjacent said portion of said outer rotating ring for removing ash from said grate.

44. The stoker of claim 33 wherein said central stationary section includes an opening therein and means exposed by said opening for diverting ash carried on said grate.

45. The stoker of claim 33 further comprising second compartment located directly under said grate for supplying pressurized air through said rotating ring and means disposed on said rotating ring for forming an air seal with said second compartment.

46. The stoker of claim 33 for use within a furnace having an inner furnace wall further comprising annular trap disposed about said inner furnace wall and about the outer periphery of said rotating ring.

* * * * *